US007251898B2

(12) United States Patent
Schafer

(10) Patent No.: US 7,251,898 B2
(45) **Date of Patent: *Aug. 7, 2007**

(54) TRANSPARENT MEASURING DEVICE WITH ENHANCED VISIBILITY LINES

(76) Inventor: Randal D. Schafer, deceased, late of Burlington, WA (US); by Margaret D. Schafer, legal representative, c/o Rulersmith Inc., P.O. Box 253, Burlington, WA (US) 98233

( * ) Notice: Subject to any disclaimer, the term of this patent is extended or adjusted under 35 U.S.C. 154(b) by 0 days.

This patent is subject to a terminal disclaimer.

(21) Appl. No.: 11/031,453

(22) Filed: Jan. 6, 2005

(65) Prior Publication Data

US 2005/0178013 A1 Aug. 18, 2005

Related U.S. Application Data

(63) Continuation-in-part of application No. 10/623,126, filed on Jul. 17, 2003, now Pat. No. 6,839,971.

(60) Provisional application No. 60/396,876, filed on Jul. 17, 2002.

(51) Int. Cl.
*B43L 7/00* (2006.01)

(52) U.S. Cl. ..... 33/1 B; 33/566

(58) Field of Classification Search ..... 33/1 B, 33/562, 563, 566

See application file for complete search history.

(56) References Cited

U.S. PATENT DOCUMENTS

| | | | | |
|---|---|---|---|---|
| 1,421,975 | A * | 7/1922 | Nicholas | 33/1 B |
| 4,475,288 | A * | 10/1984 | Pellegrom | 33/1 B |
| 4,559,705 | A | 12/1985 | Hodge et al. | 33/1 B |
| 4,742,771 | A | 5/1988 | Heilig | 101/407.1 |
| 4,779,346 | A | 10/1988 | Schafer | 33/1 B |
| 5,557,996 | A * | 9/1996 | Reber et al. | 33/563 |
| 5,819,422 | A | 10/1998 | Schafer | 33/1 B |
| 6,158,135 | A | 12/2000 | Rank | 33/494 |
| 6,434,844 | B1 | 8/2002 | Rank | 33/494 |
| 6,460,266 | B1 | 10/2002 | Painter et al. | 33/562 |
| 6,839,971 | B2 * | 1/2005 | Schafer et al. | 33/1 B |
| 6,854,189 | B2 * | 2/2005 | Schafer | 33/1 B |

* cited by examiner

*Primary Examiner*—Christopher W. Fulton
(74) *Attorney, Agent, or Firm*—Seed IP Law Group PLLC

(57) ABSTRACT

A transparent measuring device with enhanced visibility lines formed on a transparent substrate having opposing planar front and back surfaces and with at least one opaque line formed on one of the front and back surfaces and at least one transparent line formed on one of the front and back surfaces to be colinear with the at least one opaque line to present a composite line where the transparent line permits viewing of material on which the device is placed while highlighting the at least one opaque line for enhanced visibility. The transparent line may be formed of excitable pigment that reacts to light, such as a black light, or that retains luminance after exposure to light.

55 Claims, 2 Drawing Sheets

TRANSPARENT MEASURING DEVICE WITH ENHANCED VISIBILITY LINES

CROSS-REFERENCE TO RELATED APPLICATION

This application is a continuation-in-part of U.S. patent application Ser. No. 10/623,126, filed Jul. 17, 2003, which issued as U.S. Pat. No. 6,839,971 on Jan. 11, 2005, which application is incorporated herein by reference in its entirety.

BACKGROUND OF THE INVENTION

1. Field of the Invention

The present invention pertains to a device for use in measuring, marking, and cutting material, and more particularly, to a transparent ruler having composite lines formed of an opaque line and a coincident translucent line of a greater width and of a contrasting color that is configured to enhance the visibility of the composite lines.

2. Description of the Related Art

Transparent rulers having grid lines formed thereon are used for measuring and marking material, such as fabric, paper, plastic, and the like. These rulers are also used to guide a tool, such as a razor, knife, or rotary cutter in cutting the material to desired sizes and shapes.

One such ruler is that developed by the applicant and sold under the trademark Omnigrid®. This tool is described in U.S. Pat. No. 4,779,346 in the name of the applicant for a transparent measuring device that includes a plurality of continuous two-color opaque lines formed of two lines of contrasting colors. In use, these contrasting opaque lines are visible against a background of multiple colors, thus facilitating the measuring and marking of material. Another ruler is described in U.S. Pat. No. 5,819,422, which discloses a transparent measuring device and method of making the same. Each of these patents is incorporated herein in their entirety, and the subject matter thereof will not be described in detail.

Briefly, and referring to FIG. 1, illustrated therein is a portion of a transparent measuring device 10 formed in accordance with previous methods. The lines 14 are formed from a first opaque line 16 of darker color or hue and a second opaque line 18 of a contrasting color or hue. Preferably, the second line 18 will be visible on both sides of the first line 16 when viewed from the front surface 20 of the sheet 12.

The method of forming these composite multicolored lines 14 requires precision in order to avoid misalignment of the first and second opaque lines 16, 18. For example, multicolor composite line 22 in FIG. 1 is out of alignment, resulting in more of the lighter line being visible on the lower portion 24 than on the top portion 26 of the line 22. In order to manufacture this ruler with accurate alignment of the lines, multiple images must be applied via a screen printing process.

The disadvantages of the prior methods include the complex nature of the manufacturing process, that is, the forming of multiple images and the application of the images to the transparent base. Another disadvantage is that the opaque lines block the view of the material thereunder. In addition, these lines are difficult to see in low-light situations.

BRIEF SUMMARY OF THE INVENTION

The disclosed embodiments of the invention are directed to a transparent measuring device having enhanced visibility lines. In one embodiment, a tool for measuring and marking material and guiding a hand-held rotary cutting tool is provided. The tool includes a transparent substrate having mutually-opposing planar front and back surfaces, the substrate formed to have a thickness that is adapted to guide the hand-held rotary cutting tool; a first set of gridlines formed on at least one of the front and back surfaces of the transparent substrate, the first set of gridlines formed to be opaque; and a second set of gridlines formed on at least one of the front and back surfaces of the transparent substrate, the second set of gridlines formed to have a width greater than a width of the first set of gridlines and positioned to at least partially overlap the first set of gridlines, the second set of gridlines formed to be transparent and of a contrasting color to the first set of gridlines to highlight the first set of gridlines and to enable viewing of material on which the tool is placed.

In accordance with another aspect of the foregoing embodiment of the invention, the second set of gridlines are further formed from a pigment that enhances low-light viewing. Ideally, the second set of gridlines present a neon effect.

In accordance with a further aspect of the foregoing embodiment, the second set of gridlines are formed from a phosphorescent material that retains luminance after a light source is removed.

In accordance with yet a further aspect of the foregoing embodiment, the second set of gridlines are formed from a pigment that reacts to a black light to increase visibility of the second set of gridlines.

In accordance with yet another aspect of the invention, the second set of lines are formed by flexible material, such as tape, applied to the substrate coincident with the first set of lines. Ideally the tape is tinted, such as with a neon pigment or other method of tinting, or the tape is frosted. Alternatively, the second set of lines are formed by a strip of plastic, such as polyeurothane or similar material, that is substantially transparent yet is textured or tinted to present a contrasting appearance with the first set of lines to form a composite line. The tape or strip of plastic may be formed to be transparent and then tinted after application to the substrate, such as by a crayon, marker, or other similar tool. The strip may also be lithographed or silkscreened.

In accordance with still yet another aspect of the foregoing embodiment, the first set of gridlines are formed as a series of dashed lines. Preferably the second set of gridlines are formed as dashed lines to be coincident with the first set of dashed gridlines.

In accordance with another embodiment of the invention, a tool is provided that comprises a transparent base having a front surface and an opposing back surface; a plurality of gridlines formed on one of either the front and the back surface; and a plurality of transparent gridlines formed over at least a portion of the plurality of gridlines, the plurality of transparent gridlines formed to have a width greater than the plurality of gridlines to extend beyond the respective plurality of gridlines and configured to be of a contrasting color to the respective plurality of gridlines, the plurality of transparent lines formed of a pigment that enhances visibility in low-light conditions while permitting viewing therethrough.

In accordance with yet another embodiment of the invention, a tool is provided that includes a transparent substrate having at least one opaque line formed on one face; and at least one transparent line of contrasting color and overlapping on at least one side of the respective portion of the at least one opaque line on the one face of the transparent substrate, the transparent line formed of pigment that enhances visibility while permitting viewing therethrough to material below.

In accordance with yet another embodiment of the invention, a transparent measuring device having enhanced lines is provided. The device includes a transparent sheet of rigid material having planar opposing front and back surfaces; a plurality of first opaque lines formed on one of the front and back surfaces of the sheet of transparent material; a transparent sheet of flexible material adhered to the transparent sheet of rigid material; at least one transparent line formed on the one of the front and back surfaces of the transparent sheet of flexible material to be colinear with at least one first opaque line, the at least one transparent line having a width greater than the at least one first opaque line so as to be visible on at least one side of the at least one opaque line, the at least one transparent line formed of a contrasting color to a color of the at least one first opaque line; and at least one second opaque line formed on the at least one transparent line to be colinear with the first opaque line, the at least one second opaque line having a width no greater than the first opaque lines and having a color that enhances the visibility of the at least one transparent line.

In accordance with yet a further embodiment of the invention, a transparent ruler system for measuring, marking, or cutting material is provided. The system includes a rigid substrate having a plurality of opaque lines formed thereon; flexible material configured to be adhered to the substrate; and means for forming transparent lines on the flexible material that are of a contrasting color to the opaque lines on the substrate to form composite lines with respective opaque lines on the rigid substrate.

In accordance with yet another embodiment of the invention, a transparent ruler system is provided that includes a rigid substrate having a plurality of opaque lines formed thereon; and flexible material with transparent lines formed thereon and configured for application to the substrate so that the transparent lines are collinear with the opaque lines to form composite lines of contrasting color. Ideally, the flexible material is formed into segmented separable strips.

In accordance with a method of the present invention, a transparent ruler is formed by providing a rigid substrate having a plurality of opaque lines formed thereon; and providing flexible material with printed transparent lines formed thereon, the printed transparent lines having a contrasting color to the opaque lines on the substrate, the flexible material configured for application to the substrate so that the transparent lines are collinear with respective opaque lines to form composite lines of contrasting color.

As will be readily appreciated from the foregoing, the disclosed embodiments of the present invention provide a new ruler that has transparent lines highlighting opaque lines of a contrasting color that is easy to manufacture because no registration with respect to the lines is required as in previous devices. The transparent lines not only highlight the grid of opaque lines, but they permit viewing through the transparent line to the underlying material. The transparent lines are easily visible, and this may be enhanced by forming the transparent lines of phosphorescent material or material that reacts to a black light.

BRIEF DESCRIPTION OF THE SEVERAL VIEWS OF THE DRAWINGS

The foregoing features and advantages of the disclosed embodiments of the invention will be more readily appreciated as the same become better understood from the following detailed description when taken in conjunction with the accompanying drawings where.

DETAILED DESCRIPTION OF THE INVENTION

Figure 1:
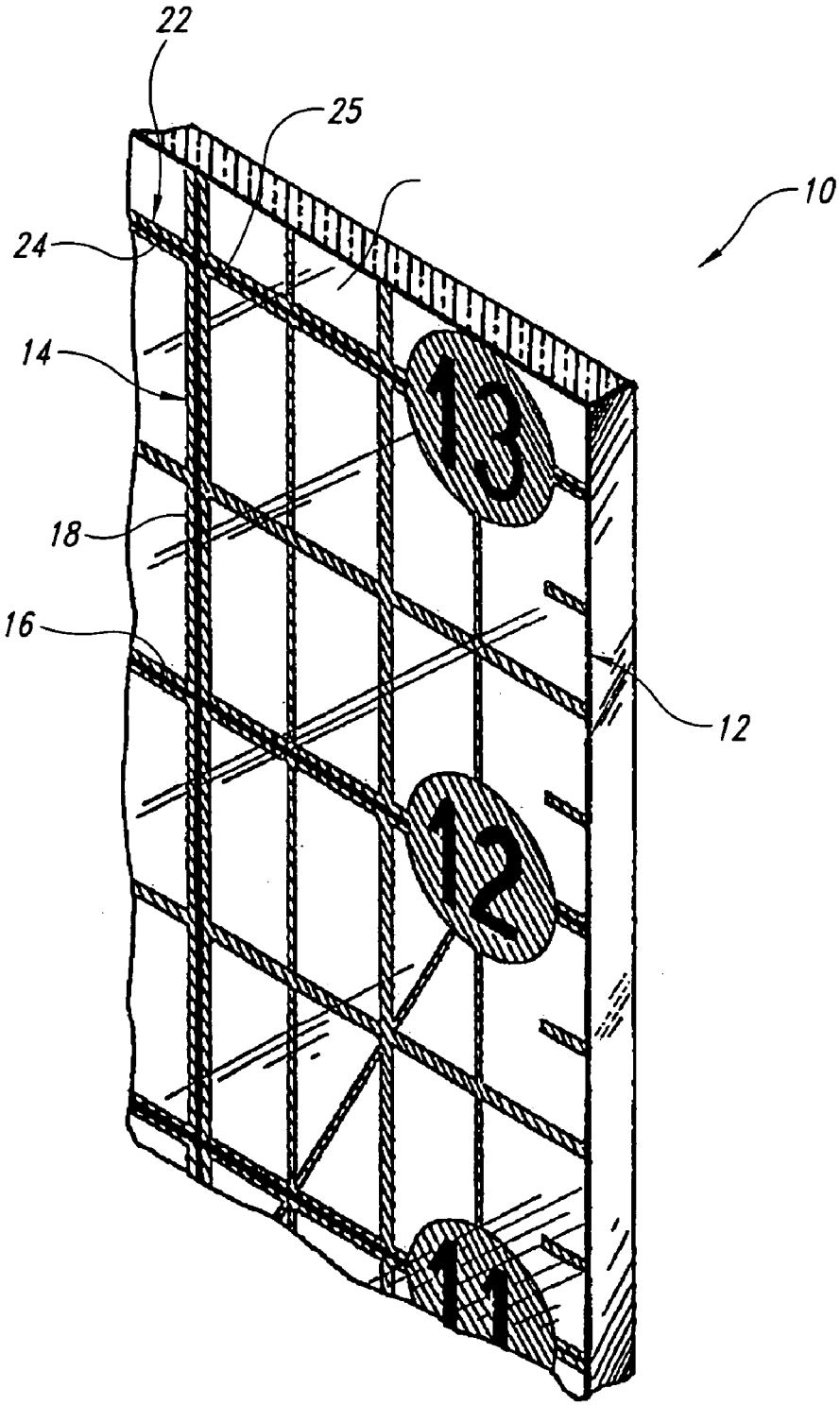
FIG. 1 (Prior Art)
FIG. 1 is an enlarged isometric view of a portion of a known transparent measuring device.
Figure 2:
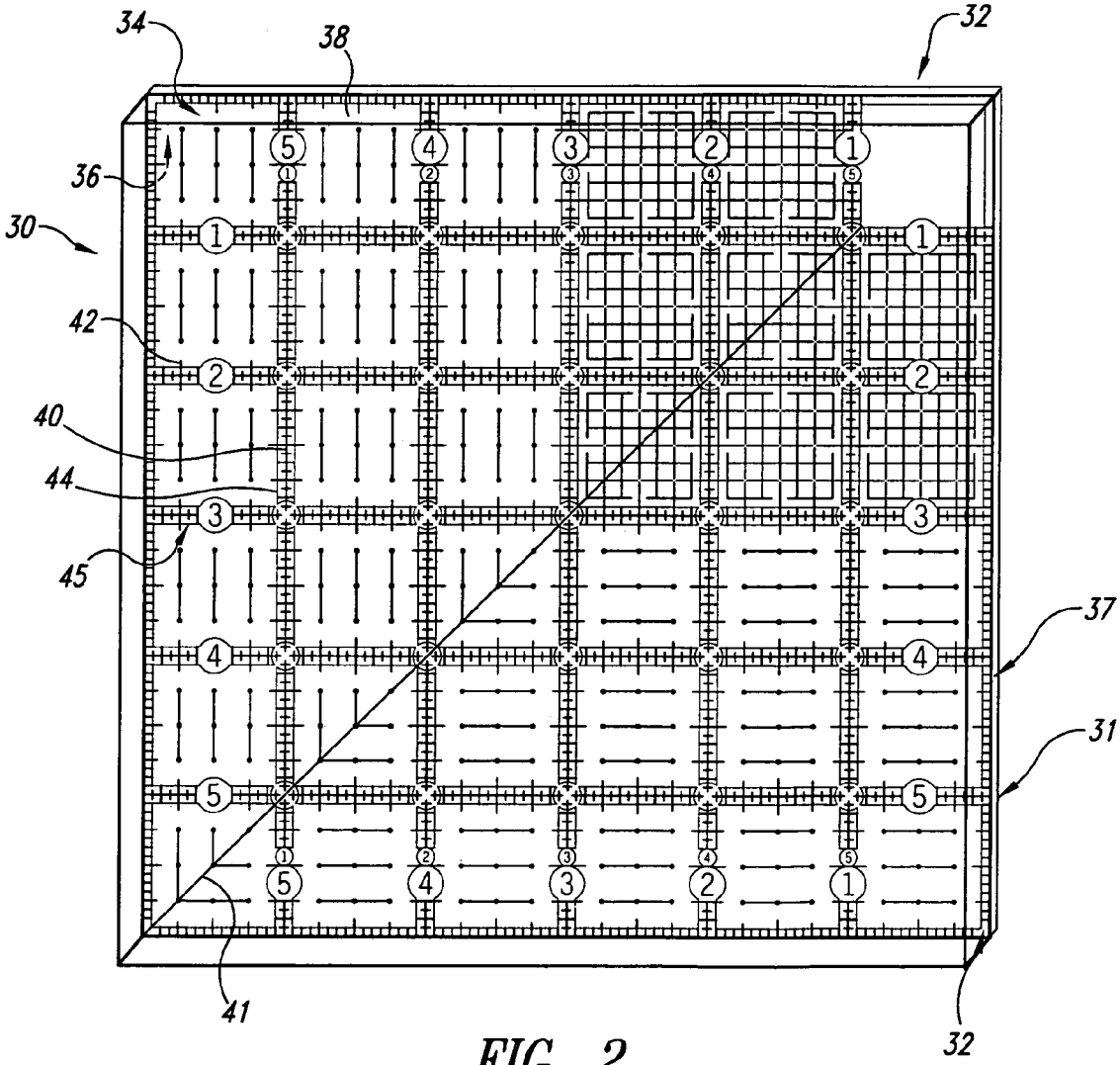
FIG. 2 is a top plan view of a transparent measuring device with enhanced visibility lines formed in accordance with the present invention.

Referring initially to FIG. 2, an improved transparent measuring device 30 is shown therein for use in measuring, marking, and cutting material. The device 30 is formed from a sheet 32 of transparent material. The sheet 32 consists of a transparent sheet of rigid material 31 having planar opposing front and back surfaces 34, 36 respectively and a transparent sheet of flexible material 33 with planar opposing front and back surfaces 35, 37 respectively. The transparent sheet of flexible material 33 is adhered to the transparent sheet of rigid material 31. Ideally the sheet 31 of transparent rigid material is formed of clear acrylic. However, other clear, rigid material that accepts ink or that accepts flexible material adhered by surface adhesion, static cling, or adhesive may be used.

In one embodiment, the sheet 32 of transparent material is sufficiently thick to form a sidewall 38 to guide a cutting tool, such as a hand-held rotary cutting tool, scissors, knife, and the like, or a marking tool.

At least one and preferably a plurality of opaque ruled lines 40 having marked graduations 42 are formed on the sheet 31, preferably on the back surface 36 to reduce parallax error. Ideally the plurality of opaque lines 40 are printed on the transparent sheet 32 by screen printing, but other methods known to those in the art may be used as well.

In the depicted embodiment of FIG. 2, the lines 40 are solid continuous lines formed at right angles to each other to create a grid-like pattern. An opaque angled line 41 is also shown in this embodiment of the device 30. Although the lines are shown as continuous, it is to be understood that the lines may be formed from a series of dashed lines spaced sufficiently close together to be visually perceived or recognized as being colinear. Ideally the plurality of opaque lines 40 are formed to be black or to have a dark appearance.

Formed coincident with the opaque lines 40 are transparent lines 44, ideally having a width greater than the width of the opaque lines 40, and ideally at least six times wider than the opaque lines 40. Preferably, the transparent lines 44 are also formed on the same surface as the opaque lines 40, which in this embodiment is the back surface 36 of the transparent sheet 32, although they may be formed on the front surface 34. In another embodiment, the transparent lines 44 are formed on the flexible sheet of material 33. The transparent lines 44 are, in one embodiment, formed with pigment that presents a contrasting color to the color of the opaque lines 40 yet is sufficiently transparent to enable viewing of material on which the device 30 is placed. In this particular embodiment, the transparent lines 44 form a composite line 45 with the opaque lines 40 such that at least one, and preferably every line, on the ruler is a composite line. However, it is to be understood that selected opaque lines may be highlighted with the transparent lines 44 so that not all of the lines on the device 30 are composite lines. The transparent lines are preferably wider than the opaque lines and at least partially overlap the opaque lines.

Preferably, the composite lines are formed of the contrasting colors yellow and black, with yellow the transparent color and black the opaque color. However, other contrasting colors may be used as well, such as an opaque dark green and a transparent white, an opaque blue and a transparent yellow, and other contrasting combinations.

The transparent lines 44 may be formed of a phosphorescent material that retains its luminance in the absence of external light. Alternatively, the transparent lines 44 may also be formed of pigment that is excitable under a neon light to enhance its visibility or that reacts to a black light. Such pigments are readily commercially available and will not be described in detail herein. In the alternative, the transparent lines 44 may be printed or formed as half tones, i.e., small dots that appear transparent from a distance.

The process for forming the plurality of opaque lines 40 begins with printing the opaque lines 40 on the back surface 36 of the sheet 32 of transparent material. This is followed up with the printing of the transparent lines 44 over the selected opaque lines 40. When the opaque lines 40 are formed as dashed lines, the transparent lines 44 may be continuous or may be co-extensive with the dashed lines, as desired.

Following the printing of the transparent lines 44, a third solid white line may be printed behind the opaque lines 40 to further enhance the visibility of the composite line. This solid white line (not shown) has a width no greater than the width of the opaque line and is placed directly on the opaque line, in this case to be visible only from the back surface 36. In contrast, the transparent line extends on one, and preferably on both sides of the opaque line 40 and the white line.

In another embodiment of the invention, the portions of the back surface 36 adjacent the sidewall 38 may also be marked with transparent lines 44, and this may be done in combination with grid markings of opaque lines, such as the white lines formed on the transparent lines, to highlight the edge of the ruler.

In accordance with yet another embodiment of the invention, the opaque lines 40 may be highlighted by transparent lines 44 of different colors. For example, composite lines extending longitudinally are formed to have yellow transparent lines 44 and transverse lines extending across the width of the ruler may be formed to have transparent lines of a pink color. The colors may also be used to denote different units of measurement, such as metric and English.

In accordance with yet another aspect of the invention, the transparent lines 44 are formed by tape applied to the substrate coincident with one or more of the opaque lines. Ideally the tape is tinted, such as with a neon pigment or other method of tinting. The tape can be frosted instead of colored. The frosted tape presents a whitish appearance when applied to the substrate over the opaque lines 40, thus creating a composite line of contrasting appearance.

Alternatively, the transparent lines 44 can be formed by a strip of flexible plastic, such as polyurethane, vinyl, mylar, or similar material known to those skilled in the art, that is substantially transparent yet is textured or tinted to present a contrasting appearance with the opaque lines to form composite lines 45. The tape or strip of plastic may be formed to be transparent and then tinted after application to the substrate, such as by a crayon, marker, or other similar tool. The strip may be formed from a larger sheet of material that is lithographed or silk screened and then cut or segmented into strips. This larger sheet of material may be adhered to the substrate through surface adhesion, static cling, or a light adhesive applied to one side of the larger sheet of material or to the strips after cutting. Ideally, the flexible material has a thickness in the range of 1 to 25 mil, and ideally 5-8 mil. The strip may be formed from chart tape or graphic tape that is readily commercially available, or it may be in sheet form as described above. One such material is a thermoplastic elastomer ST-625CL-85 available from Stevens, Inc., in Holyoke, Mass.

While preferred embodiments of the invention have been illustrated and described, it is to be understood that changes may be made therein without departing from the spirit and scope of the invention. As will be readily appreciated from the foregoing, the present invention provides a transparent measuring device with enhanced visibility lines. It is useful with long-arm quilting devices where the visibility of the lines is important. It is especially useful for those with poor vision. The composite lines are transparent through at least a portion thereof to permit viewing of the material on which the ruler is placed.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims and the equivalents thereof.

The invention claimed is:

1. A transparent measuring device having enhanced lines, comprising:

a transparent sheet of rigid material having planar opposing front and back surfaces;

a plurality of first opaque indicia formed on one of the front and back surfaces of the sheet of transparent material;

a transparent sheet of flexible material adhered to the transparent sheet of rigid material, the transparent sheet of flexible material have a front surface and a back surface;

at least one transparent indicia formed on one of the front and back surfaces of the transparent sheet of flexible material, the at least one transparent indicia having a width greater than the at least one first opaque indicia so as to be visible on at least one side of the at least one opaque indicia when positioned collinear with the at least one opaque indicia, the at least one transparent indicia formed of a contrasting color to a color of the at least one first opaque indicia; and at least one second opaque indicia formed on the at least one transparent line to be colinear with at least one of the first opaque indicia, the at least one second opaque indicia having a color that enhances the visibility of the at least one transparent indicia.

2. The device of claim 1 wherein the at least one transparent indicia is formed of a pigment that reacts to light to provide enhanced visibility.

3. The device of claim 1 wherein the at least one transparent indicia is formed of a pigment that reacts to black light.

4. The device of claim 1 wherein the at least one transparent indicia is formed of a pigment that presents a neon effect.

5. The device of claim 1 wherein at least one of the plurality of first opaque indicia comprises colinear dashes.

6. The tool of claim 1 wherein of the plurality of at least one transparent line comprises a dashed indicia.

7. The tool of claim 1 wherein at least one of the plurality of first opaque indicia and a corresponding at least one transparent indicia are formed as coincident dashed indicia.

8. The tool of claim 1 wherein the at least one transparent indicia is formed of a pigment that is excitable when exposed to light and retains luminance when not exposed to light.

9. The tool of claim 1 wherein the at least one transparent indicia is formed of a phosphorescent pigment.

10. The tool of claim 1 wherein the transparent sheet of flexible material comprises a strip of flexible material sized and shaped to be applied over a single first opaque indicia.

11. The tool of claim 10 wherein the strip comprises a tape having adhesive on one side.

12. A transparent ruler system for measuring, marking, or cutting material, comprising:

a rigid substrate having a plurality of opaque lines formed thereon; and transparent flexible material with transparent lines formed thereon and configured for application to the substrate so that the transparent lines are collinear with the opaque lines to form composite lines of contrasting color, the contrasting color formed of a pigment that reacts to light to provide enhanced visibility.

13. The system of claim 12 wherein the flexible material is segmented into separable strips for application to the substrate.

14. A method of forming a transparent ruler system for measuring, marking, or cutting material, the method comprising:

providing a rigid substrate having a plurality of opaque lines formed thereon; and providing flexible material with printed transparent lines formed thereon, the printed transparent lines having a contrasting color to the opaque lines on the substrate, the flexible material configured for application to the substrate so that the transparent lines are collinear with respective opaque lines to form composite lines of contrasting color, the contrasting color formed of a pigment that reacts to light to provide enhanced visibility.

15. The method of claim 14, further comprising forming an opaque line over the transparent line on the flexible material to enhance the visibility of the transparent line when the flexible material is applied to the substrate to align the opaque white line with the opaque line on the substrate.

16. The method of claim 15 wherein the opaque white line on the flexible material is formed to have a width no greater than a width of a respective opaque line on the substrate.

17. The method of claim 16, further comprising segmenting the flexible material into separable strips.

18. A transparent ruler, comprising:

a rigid transparent substrate;

at least one transparent indicia on the substrate; and a white opaque indicia formed on the at least one transparent indicia and having a width less that a width of the at least one transparent indicia to enhance visibility of the at least one transparent indicia.

19. The ruler of claim 18 wherein the at least one transparent indicia and the white opaque indicia comprise grid markings.

20. The ruler of claim 18 wherein the at least one transparent and the white opaque indicia are formed in the shape of numbers.

21. A tool, comprising:

a transparent substrate having a plurality of opaque lines formed on at least one surface thereof; and a plurality of transparent lines of a contrasting color to the plurality of opaque lines and formed over the opaque lines to at least partially overlap the respective opaque lines, the plurality of transparent lines formed of a pigment that enhances the visibility of the plurality of transparent lines in a low-light condition, the plurality of overlapping transparent and opaque lines forming colinear composite lines structured to converge at points of convergence without touching to form a transparent viewing area at each point of convergence, wherein the pigment comprises one from among a pigment that is excitable when exposed to light and retains luminance for a period of time when the light is removed, a phosphorescent pigment, and pigment that reacts to black light.

22. The device of claim 21 wherein the plurality of opaque lines form angles with respect to one another to enable precise angle measurements by a user.

23. A transparent measuring device having enhanced lines, comprising:

a transparent sheet of material having planar opposing front and back surfaces;

a plurality of first opaque lines formed on one of the front and back surfaces of the sheet of transparent material;

at least one transparent line formed on the one of the front and back surfaces of the transparent sheet of material to be colinear with at least one first opaque line, the at least one transparent line having a width greater than the at least one first opaque line so as to be visible on at least one side of the at least one opaque line, the at least one transparent line formed of a contrasting color to a color of the at least one first opaque line, the at least one colinear transparent line with the at least one first opaque line forming colinear composite lines structured to converge at points of convergence without touching to form a transparent viewing area at each point of convergence; and at least one second opaque line formed on the at least one first opaque line to be colinear with the first opaque line, the at least one second opaque line having a width no greater than the first opaque lines and having a color that enhances the visibility of the at least one transparent line, the at least one opaque line is formed from colinear dashes.

24. The device of claim 23 wherein the transparent line is formed of a pigment that reacts to light to provide enhanced visibility.

25. The device of claim 23 wherein the at least one transparent line is formed of a pigment that reacts to black light.

26. The device of claim 23 wherein the at least one transparent line is formed of a pigment that presents a neon effect.

27. A tool for measuring and marking material and for guiding a hand-held cutting tool, comprising:

a transparent substrate having mutually-opposing planar front and back surfaces and formed of a thickness that is adapted to guide the hand-held rotary cutting tool;

a first set of opaque lines formed on at least one of the front and back surfaces of the transparent substrate; and at least one transparent line formed on at least one of the front and back surfaces of the transparent substrate and colinear with at least one first opaque line of the first set of opaque lines, the at least one transparent line formed to have a width greater than a width of the respective at least one first opaque line and positioned to at least partially overlap the at least one first opaque line, the at least one transparent line formed of a contrasting color to a color of the at least one first opaque line, the at least one transparent line overlapping the at least first opaque line forming colinear composite lines structured to converge at points of convergence without touching to form a transparent viewing area at each point of convergence, wherein the at least one transparent line is formed of one from among a pigment that is excitable when exposed to light and retains luminance when not exposed to light, a phosphorescent pigment, and a pigment that is responsive to black light.

28. The tool of claim 27 wherein the at least one first opaque line is formed as a dashed line.

29. The tool of claim 27 wherein the at least one first opaque line and the at least one transparent line are formed as coincident dashed lines.

30. The tool of claim 27, wherein the at least one transparent line is formed from flexible material applied to the substrate.

31. The tool of claim 30, wherein the flexible material comprises a strip of flexible material sized and shaped to be applied over a single first opaque line.

32. The tool of claim 31, wherein the strip comprises a tape having adhesive on one side.

33. The tool of claim 27, further comprising at least one second opaque line formed on the at least one first opaque line to be colinear with the at least one first opaque line of the first set of opaque lines, the at least one second opaque line formed to have a width no greater than the width of the at least one first opaque line and of a color that enhances the visibility of the at least one transparent line when placed against the material.

34. The tool of claim 33, wherein the at least one second opaque line is white.

35. The tool of claim 33 wherein the transparent line is formed from half-tones.

36. the tool of claim 27 wherein the width of the transparent line is at least six times the width of the opaque line.

37. A tool for use in measuring, marking, and cutting material, comprising:

a transparent substrate having mutually-opposing planar front and back surfaces;

a set of opaque lines formed on at least one of the front and back surfaces of the transparent substrate; and at least one piece of flexible material applied to the transparent substrate to form an enhanced visibility composite line with at least one opaque line from the set of opaque lines and wherein at least one transparent line is formed on the flexible material of contrasting color to a color of the at least one opaque line and is aligned with the at least one opaque line to at least partially overlap the at least one opaque line, the transparent line adapted to enhance the visibility of the composite line in low-light conditions, the overlapping transparent line and the at least one opaque line forming colinear composite lines structured to converge at points of convergence without touching to form a transparent viewing area at each point of convergence, wherein the transparent line is formed of one from among a pigment that is excitable when exposed to light and retains luminance when not exposed to light, a pigment that is responsive to black light, and a phosphorescent pigment.

38. The tool of claim 37, further comprising a white line formed over the opaque line, the white line having a width no greater than a width of the opaque line and visible only from the back surface of the transparent substrate.

39. A method of forming a tool for use in measuring, marking, and cutting material, the method comprising:

providing a substrate that is rigid and transparent and having mutually-opposing planar front and back surfaces;

forming at least one opaque line on one of the front and back surfaces of the substrate; and forming a transparent line over the at least one opaque line, the transparent line formed to have a width greater than a width of the opaque line and positioned to at least partially overlap the opaque line, the transparent line formed of a color that is contrasting to the color of the opaque line and that reacts to light to provide enhanced visibility of the composite line formed by the transparent line and the opaque line, the at least one overlapping opaque and transparent lines forming colinear composite lines structured to converge at points of convergence without touching to form a transparent viewing area at each point of convergence.

40. The method of claim 39, wherein the transparent line is formed of a lighter color than the opaque line.

41. The method of claim 39, wherein the transparent line is formed of a pigment that reacts to light to provide enhanced visibility.

42. The method of claim 39, wherein the transparent line is formed of a pigment that reacts to black light.

43. The method of claim 39, wherein the transparent line is formed of a pigment that presents a neon effect.

44. The method of claim 39, wherein the opaque line is formed from colinear dashes.

45. The method of claim 39, wherein the transparent line is formed on a flexible material that is applied to the substrate.

46. The method of claim 45, wherein the flexible material comprises non-static cling material.

47. The method of claim 39, further comprising forming a white line over the at least one opaque line, the white line having a width no greater than a width of the opaque line and visible only from the back surface of the substrate.

48. A method of forming a tool for use in measuring, marking, and cutting material, the method comprising:

providing a transparent substrate having mutually-opposing planar front and back surfaces;

forming a first set of opaque lines on at least one of the front and back surfaces of the transparent substrate;

forming a second set of opaque lines over the first set of opaque lines, the second set of opaque lines having a width no greater than a width of the first set of opaque lines and of a white color; and applying a flexible material to the substrate, the flexible material having a transparent line formed thereon of a width greater than a width of at least one opaque line of the first set of opaque lines and positioned to at least partially overlap the at least one opaque line, the transparent line formed of a lighter contrasting color to a color of the at least one opaque line to form a composite line of the transparent line and the at least one opaque line, the transparent line formed to react to light to enhance the visibility of the transparent line in a predetermined light condition, the overlapping set of opaque lines and the transparent lines forming colinear composite lines structured to converge at points of convergence without touching to form a transparent viewing area at each point of convergence, and wherein the predetermined light condition comprises one from between a black light condition and a low-light condition.

49. A method of making a tool, comprising:

providing a substrate formed of transparent, rigid material having planar opposing front and back surfaces;

forming a plurality of first opaque lines on one of the front and back surfaces of the sheet of transparent material; and forming at least one transparent line on one of the front and back surfaces of the transparent sheet of material to be colinear with at least one first opaque line, the at least one transparent line having a width greater than the at least one first opaque line so as to be visible on at least one side of the at least one opaque line, the at least one transparent line formed of a contrasting color to a color of the at least one first opaque line, the at least overlapping opaque and transparent lines forming colinear composite lines structured to converge at points of convergence without touching to form a transparent viewing area at each point of convergence, and further comprising forming at least one second opaque line on at least one first opaque line to be colinear with the at least one first opaque line and formed to be between the at least one first opaque line and the transparent line and having a width no greater than the first opaque line, the at least one second opaque line having a color that enhances the visibility of the at least one transparent line, and forming the at least one transparent line comprises forming the at least one transparent line of one from among a pigment that reacts to light to provide enhanced visibility, a pigment that reacts to black light, and a pigment that presents a neon effect.

50. A method of making a tool for measuring and marking material and for guiding a hand-held cutting tool, comprising:

forming a transparent substrate of a rigid material having mutually-opposing planar front and back surfaces and formed to have a thickness that is adapted to guide the hand-held rotary cutting tool;

forming a first set of opaque lines formed on at least one of the front and back surfaces of the transparent substrate;

forming at least one set of transparent lines on at least one of the front and back surfaces of the transparent substrate and colinear with the first set of opaque lines, the at least one set of transparent lines formed of a width at least six times greater than a width of the respective first set of opaque lines and positioned to at least partially overlap the first set of opaque lines, the at least one set of transparent lines formed of a contrasting color to a color of the first set of opaque lines, the at least one set of transparent lines overlapping the first set of opaque lines forming colinear composite lines structured to converge at points of convergence without touching to form a transparent viewing area at each point of convergence, wherein the at least one set of transparent lines is formed of one from among a pigment that is excitable when exposed to light and retains luminance when not exposed to light, a phosphorescent pigment, and a material that presents a neon effect to a user; and forming a second set of opaque lines directly on the first set of opaque lines and between the first set of opaque line and the at least one set of transparent lines, the second set of opaque lines having a width no greater than the width of the first set of opaque lines and having a color that enhances the visibility of the at least first set of transparent lines.

51. The method of claim 50, wherein the first set of opaque lines is formed as dashed lines.

52. The method of claim 50, wherein the first set of opaque lines and the at least one set of transparent lines are formed as coincident dashed lines.

53. A method of forming a tool for measuring and marking material and for guiding a hand-held cutting tool, comprising:

providing a rigid transparent substrate having mutually-opposing planar front and back surfaces and formed to have a thickness that is adapted to guide the hand-held rotary cutting tool;

forming a first set of opaque lines on at least one of the front and back surfaces of the transparent substrate;

forming a second set of opaque lines on the first set of opaque lines and having a width no greater than the first set of opaque lines; and forming a set of transparent lines on the second set of opaque lines and having a width at least six times greater than the width of the second set of opaque lines and the first set of opaque lines and to be colinear with the first and second sets of opaque lines, the set of transparent lines positioned to overlap both sides of the first and second sets of opaque lines, the set of transparent lines formed of a contrasting color to a color of the first set of opaque lines, the set of transparent lines overlapping the first and second sets of opaque lines forming colinear composite lines structured to converge at points of convergence without touching to form a transparent viewing area at each point of convergence, and wherein the set of transparent lines is formed of one from among a pigment that is excitable when exposed to light and retains luminance when not exposed to light, a phosphorescent pigment, a pigment that is responsive to light, and a material that presents a neon effect to a user.

54. The method of claim 53, wherein the first and second sets of opaque lines are formed as coincident dashed lines.

55. The method of claim 53, wherein the second set of opaque lines is formed of a color that enhances the visibility of the set of transparent lines when the tool is placed on the material.

* * * * *